US005748057A

United States Patent [19]

De Los Santos

[11] Patent Number: 5,748,057

[45] Date of Patent: May 5, 1998

[54] PHOTONIC BANDGAP CRYSTAL FREQUENCY MULTIPLEXERS AND A PULSE BLANKING FILTER FOR USE THEREWITH

[75] Inventor: Hector J. De Los Santos, Inglewood, Calif.

[73] Assignee: Hughes Electronics, Los Angeles, Calif.

[21] Appl. No.: 656,742

[22] Filed: Jun. 3, 1996

[51] Int. Cl.[6] ..... H01P 5/12

[52] U.S. Cl. ..... 333/134; 333/202

[58] Field of Search ..... 333/126, 129, 333/132, 134, 135, 202, 219, 219.1

[56] References Cited

U.S. PATENT DOCUMENTS

| | | | |
|---|---|---|---|
| 4,052,724 | 10/1977 | Takeichi et al. | 333/135 X |
| 5,281,934 | 1/1994 | Shiau et al. | 333/134 |
| 5,440,281 | 8/1995 | Wey et al. | 333/126 |
| 5,471,180 | 11/1995 | Brommer et al. | 333/202 |

*Primary Examiner*—Paul Gensler

*Attorney, Agent, or Firm*—Elizabeth E. Leitereg; Terje Gudmestad; W. K. Denson-Low

[57] ABSTRACT

Frequency multiplexers that incorporate either a power divider network or a power coupling cavity in conjunction with photonic bandgap filters. The frequency multiplexers comprise a signal input and a plurality of signal outputs. In a first embodiment of the multiplexer, a 1-to-N power divider network is coupled to the signal input, and a predetermined number of photonic bandgap filters are coupled between the divider network and the plurality of signal outputs and that are driven by the divider network. Each photonic bandgap filter has an predetermined bandpass characteristic such that the plurality of filters cover the total input signal bandwidth. In a second embodiment of the multiplexer, a cavity is formed between the signal input and the plurality of filters. The spatial locations of the filters tailor the propagation properties of the cavity so that a corresponding plurality of propagating modes are established linking the different input frequency bands and the signal output. Each filter comprises a wave launching antenna, a waveguide-like cavity, a receiving antenna, and a photonic bandgap crystal disposed in the waveguide-like cavity that comprises a dielectric substrate having upper and lower metal boundaries that define lengths of dielectric members therein, and at least one switch interconnecting pairs of dielectric members formed in the substrate.

16 Claims, 3 Drawing Sheets

Fig. 1
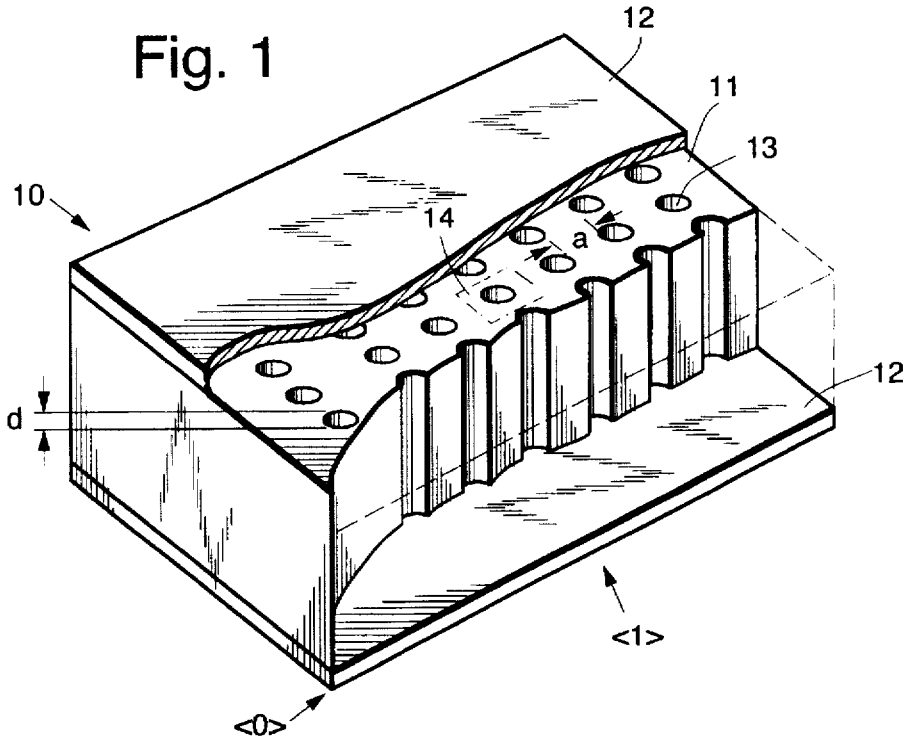
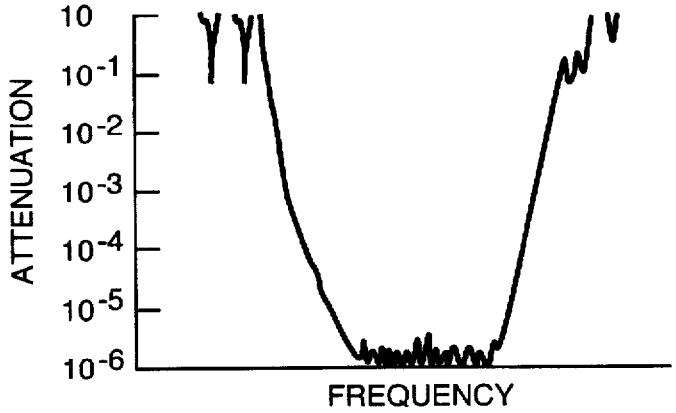
Fig. 2
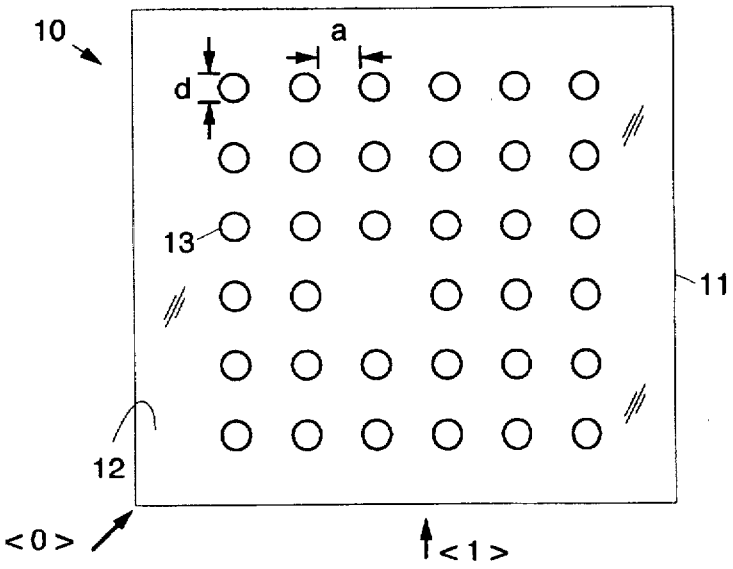
Fig. 3

PHOTONIC BANDGAP CRYSTAL FREQUENCY MULTIPLEXERS AND A PULSE BLANKING FILTER FOR USE THEREWITH

BACKGROUND

The present invention relates generally to multiplexers, and more particularly, to photonic bandgap crystal frequency multiplexers that use pulse blanking filters.

Multiplexing provides a means of sub-dividing a wide frequency band into a number of narrower bands, or reciprocally, of combining frequency bands at a common port. Most of the uses for multiplexers involve routing signals among devices of different bandwidths. A typical application is connecting a multi-octave-bandwidth antenna to different octave-bandwidth receivers. Conventional multiplexers are based on lumped or distributed components (inductors, capacitors, transmission lines, and resonators), which tend to be bulky, heavy, tuning-intensive, and have a host of reliability hazards.

Conventional frequency multiplexers are either contiguous or noncontiguous. In a noncontiguous multiplexer, passbands are separated in frequency, whereas in a contiguous multiplexer, the passbands are adjacent, with no intervening guard bands. The art of multiplexing involves combining several filters in such a way that undesirable mutual interactions are eliminated. Additionally, the overall size of the multiplexer should be minimized.

Prior art multiplexers are typically designed in one of the following forms. Filters are connected in series, or parallel, and mismatched immittance is compensated by means of an additional network at a common junction. The first resonator of each conventionally designed filter is eliminated, which has the effect of canceling junction susceptances, while causing the real part of the immittances to add to near unity on a normalized basis. Prior art multiplexers may be formed from a synthesis of filters specifically designed to match when multiplexed. The first few elements (i.e., those closest to the common junction) of conventional doubly terminated filters may be modified. Space filters may be disposed along a manifold and phase shifters are used between channels to effect the immittance compensation, while preserving the canonic form of the filter networks.

Prior art pulse blanking functions have been implemented using active attenuator-like networks which, upon command, adopted an open or closed state. This approach suffers from at least two drawbacks. The operation of these active solid state devices deteriorates once their exposure reaches a certain threshold of energy or power, and eventually become inoperative. During the time of duration of the high energy or power exposure, the signal of interest is totally lost.

Accordingly, it is an objective of the present invention to provide for photonic bandgap crystal frequency multiplexers that use pulse blanking filters that overcome the limitations of conventional devices.

SUMMARY OF THE INVENTION

To meet the above and other objectives, the present invention provides for improved frequency multiplexers that incorporate either a power divider network or a power coupling cavity in conjunction with photonic bandgap filters. The present invention provides for a totally new approach to the design of frequency multiplexers wherein filtering functions are realized using photonic crystals. Photonic crystals have concomitant advantages including extremely low weight, high modularity, they need no tuning, and have high reliability. In addition, the present frequency multiplexers permit the input signal power to be coupled to each filter independently of the others. As a result, problems due to filter interaction are inherently nonexistent.

More particularly, the present invention provides for frequency multiplexers that incorporate either a power divider network or a power coupling cavity in conjunction with photonic bandgap filters. The frequency multiplexers comprise a signal input and a plurality of signal outputs.

In a first embodiment of the multiplexer, a 1-to-N power divider network is coupled to the signal input, and a predetermined number of photonic bandgap filters are coupled between the divider network and the plurality of signal outputs. Each photonic bandgap filter has a bandpass characteristic such that the plurality of filters cover the total input signal bandwidth.

In a second embodiment, a cavity is formed between the signal input and the plurality of filters. The spatial locations of the filters tailor the propagation properties of the cavity so that a corresponding plurality of propagating modes are established linking the different input frequency bands and the signal output.

Each filter comprises a wave launching antenna, a waveguide-like cavity, a receiving antenna, and a photonic bandgap crystal disposed in the waveguide-like cavity. The photonic bandgap crystal comprises a dielectric substrate having upper and lower metal boundaries that define lengths of dielectric members therein, and at least one switch interconnecting pairs of dielectric members formed in the substrate.

The most important advantage of the present frequency multiplexers is that, compared to conventional art, a very substantial reduction in weight, up to 90%, is realized. This reduction in weight has a tremendous impact on spacecraft launching cost, mission life, and communications payload capability, to name a few. The present frequency multiplexers have a tremendous impact on the weight, size, capability, life span, and cost of communications satellites. Frequency multiplexers are among the bulkiest, and heaviest components used in communications satellites.

In addition to the above multiplexers, the present invention provides for a photonic bandgap filter, or pulse blanking filter, that employs photonic bandgap crystals and microelectromechanical switches (MEMS) and that may be employed in the improved frequency multiplexers of the present invention.

The pulse blanking filter controllably blocks an incoming high-power signal in such a way that some or all of its constituent frequency components are reflected or transmitted. The advantage of the present invention is that it exhibits virtually complete imperviousness to the level of energy/power exposure, since the switches operate as passive mechanical switches, rather than active semiconductor switches. In addition, the present invention allows for filtering of the incoming signal so that a reduced energy or power level may be transmitted in the presence of the high energy/power undesired signal.

The present pulse blanking filter may be used in communications equipment, both civilian and military, whose performance may be impaired by "jamming" due to high-energy/power signals. In addition, the pulse blanking filter may be used as a programmable filter, whose passband can be made to "pop-up" at various locations within the stopband, as desired, by simply opening and closing the appropriate switches.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is a cut away view of a two-dimensional photonic crystal;

FIG. 2 is a graph illustrating transmission attenuation versus frequency through a defect-free photonic crystal;

FIG. 3 is a top view of two-dimensional photonic crystal with an acceptor defect;

DETAILED DESCRIPTION

Figure 4:
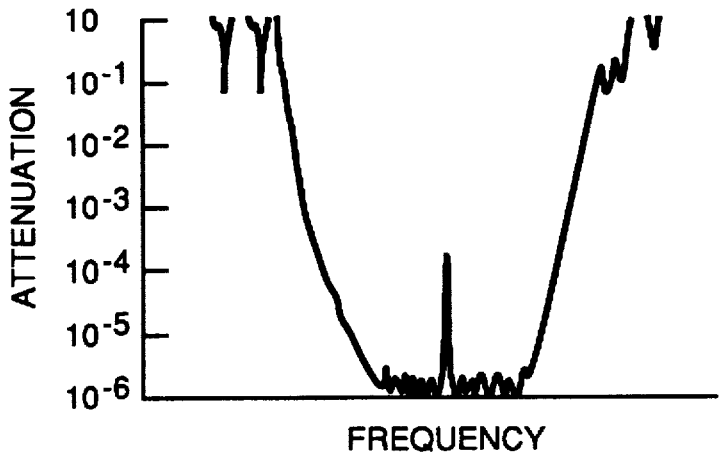
FIG. 4 is a graph illustrating transmission attenuation through a photonic crystal with a single acceptor.

Referring to the drawing figures, FIG. 1 is a top view of a two-dimensional photonic bandgap crystal 10 that comprises a substrate 11 and a plurality of dielectric rods 13 or members 13 having diameter "d" and a lattice constant "a". The <0> and <1> of crystal lattice orientations of the photonic bandgap crystal 10 are shown in FIG. 1. The plurality of dielectric rods 13 or members 13 form cells 14 within the crystal 10. The photonic bandgap crystal 10 is a periodic one-, two-, or three-dimensional dielectric array, which exhibits a dispersion relation possessing frequency ranges where transmission is forbidden, i.e., bandgaps. Thus the photonic bandgap crystal 10 responds to electromagnetic waves in the same manner that semiconductor crystals responds to electrons. This is shown in FIG. 2, which is a graph illustrating transmission attenuation versus frequency through a defect-free photonic crystal 10.

The perfect translational symmetry of the dielectric structure of the defect-free photonic crystal 10 can be altered in one of two ways. Extra dielectric material may be added to one of the cells 14, which results in a defect that behaves like a donor atom in a semiconductor, or dielectric material may be removed from one of the cells 14. This is illustrated in FIG. 3, which is a top view of two-dimensional photonic crystal 10 having an acceptor defect. Altering the symmetry of the dielectric structure gives rise to a defect that behaves like an acceptor atom in a semiconductor. FIG. 4 is a graph illustrating transmission attenuation through a photonic crystal 10 of FIG. 3 with a single acceptor. The present invention is implemented by altering the symmetry of the dielectric structure as shown in FIG. 3.

Figure 5:
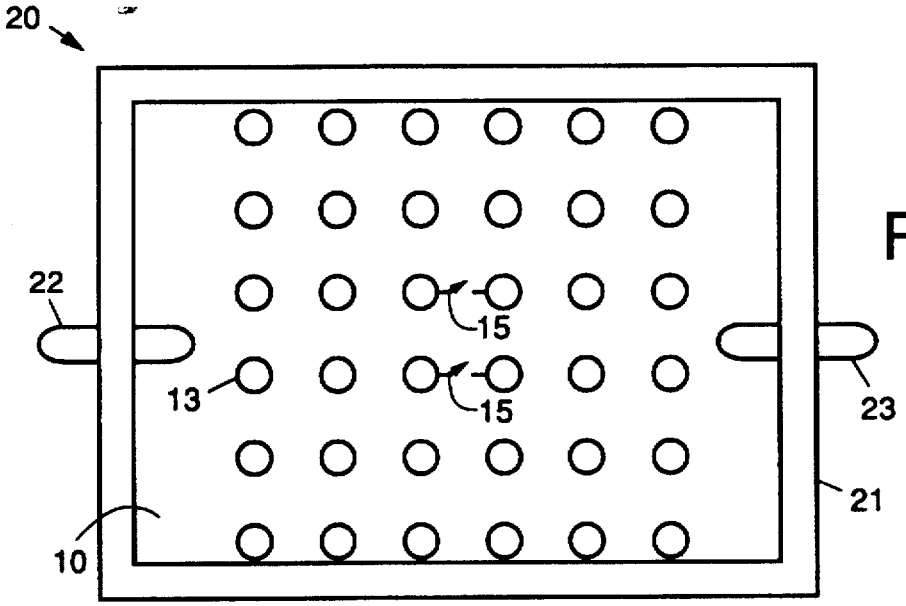
FIG. 5 illustrates a pulse blanking filter in accordance with the principles of the present invention.

To effect the "removal" of dielectric material in the two-dimensional array of cells 14 or rods 13 in the photonic bandgap crystal 10 of FIG. 1, for instance, a high-isolation, low-loss switch 15 (or switches 15) is interposed between two or more dielectric rods 13 (shown in FIG. 5). The periodic arrangement, and therefore the frequency bandgap, is obtained when the switch 15 is in an open condition. The allowed frequency pops-up in the bandgap whenever the switch 15 is closed. Closing the switch 15, in effect, "moves" the dielectric rod 13 from its original position, thus creating a defect, such as is shown in FIG. 3.

Now, referring to FIG. 5, it illustrates a photonic bandgap filter 20, or pulse blanking filter 20, in accordance with the principles of the present invention. The photonic bandgap filter 20 comprises a wave launching antenna 22, a waveguide-like cavity or structure 21, and a receiving antenna 23. The waveguide-like structure 21 houses the dielectric array comprising the photonic bandgap crystal 10, which may be two-dimensional, for example, that has upper and lower metal boundaries 12 that define the lengths of the dielectric rods 13, and one or more switches 15 located in the substrate 11 interconnecting pairs of rods 13. Considerable latitude is available for realizing the antennas 22, 23 and dielectric array pattern. In a reduced-to-practice embodiment of the present invention a microelectromechanical switch 15 or switches 15 are used to change the transmission properties of the photonic bandgap crystal 10.

The microelectromechanical switches 15 have high isolation (~40 dB), low loss (<0.5 dB), and large bandwidth (~40 GHz), and most importantly, provide mechanical contact operation, that are necessary for implementing the present invention. The lengths of the rod 13, as set by upper and lower metal boundaries 12 of the photonic bandgap crystal 10, are chosen smaller than the intended wavelengths of operation so that electromagnetic wave propagation is two-dimensional.

Figure 6:
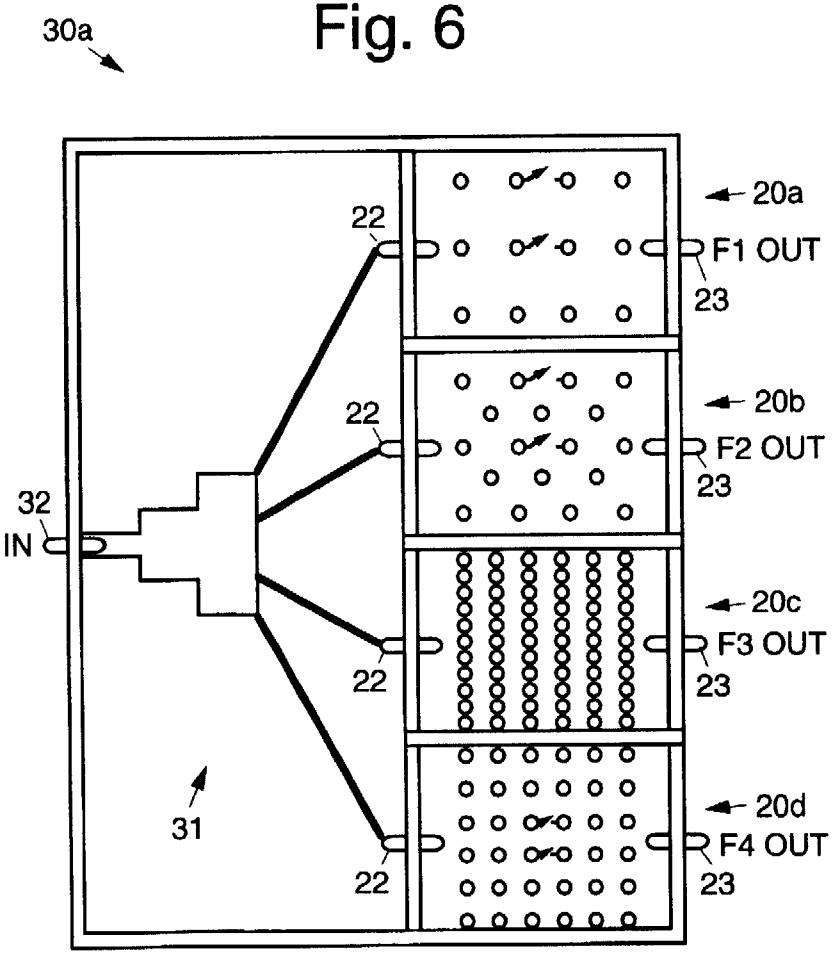
FIG. 6 illustrates a first embodiment of a photonic bandgap crystal frequency multiplexer in accordance with the principles of the present invention employing power-frequency divider coupling.

The above-described photonic crystal may be advantageously employed to produce a variety of frequency multiplexers in accordance with the present invention. FIG. 6 illustrates a first embodiment of a photonic bandgap crystal frequency multiplexer **30*a* in accordance with the principles of the present invention. The frequency multiplexer 30*a* comprises a power-frequency divider network 31 that couples electromagnetic energy to a plurality (N) of photonic bandgap filters 20*a*–20*d***.

More specifically, the frequency multiplexer **30*a* comprises a signal input 32 and a plurality of signal outputs 23. The frequency multiplexer 30*a* uses a 1-to-N power divider network 31 coupled to the signal input 32 to drive a predetermined number of photonic bandgap filters 20, shown in FIG. 6 as four (N=4) photonic bandgap filters 20*a*–20*d*. Each photonic bandgap filter 20*a*–20*d* is designed to provide an appropriate bandpass characteristic so that, together, the photonic bandgap filters 20*a*–20*d* cover a total input signal bandwidth. The filtered outputs of the respective photonic bandgap filters 20*a*–20*d* are output through the respective signal outputs 23. The photonic bandgap crystals used in the photonic bandgap filters 20*a*–20*d* are comprised of a periodic one-, two-, or three-dimensional dielectric array, and operates as described above. It is to be understood, however, that the photonic bandgap filters 20*a*–20*d*** may require an implementation that uses different unit cell arrangements, periodicity, lattice constants, and dielectric constants, etc.

The principle of operation of the multiplexer **30*a* is as follows. An input signal applied to the signal input 32 is distributed to the various filters 20*a*–20*d* by various legs of the divider network 31 which terminate at a filter 20*a*–20*d*. At frequencies outside their respective passbands, the input impedance of the filters 20*a*–20*d* behave as a "short circuit". Physically, each of the frequency components of the input signal, F1 through F4, only "sees" the path leading to the output port 23 that is loaded by the filter 20*a*–20*d*** whose passband matches it. Multiplexing occurs by virtue of the fact that the load terminations provided by the filters 20a–20d to the divider network 31 tailor the propagation properties of the divider network 31 in such a way that, in addition to each branch carrying a fraction of the input power, it also carries a fraction of the input bandwidth, namely, that fraction and frequency content corresponding to the passband of the filter 20a–20d that terminates it.

Figure 7:
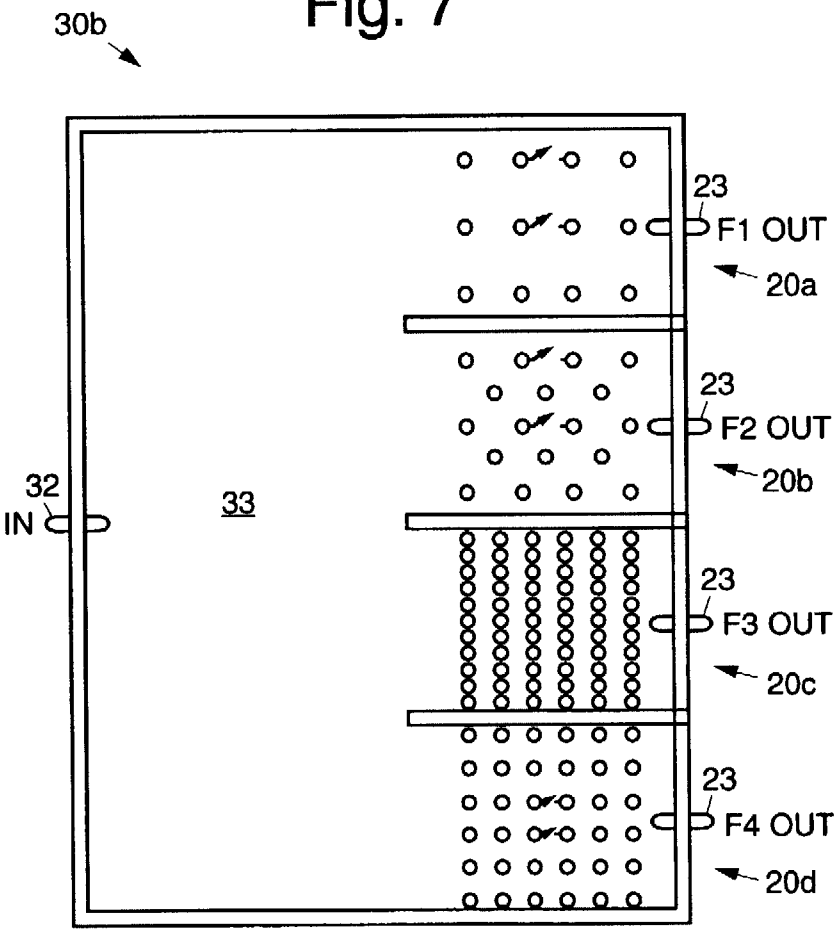
FIG. 7 illustrates a second embodiment of a photonic bandgap crystal frequency multiplexer in accordance with the principles of the present invention employing cavity-mode selection coupling.

Referring now to FIG. 7, it illustrates a second embodiment of a photonic bandgap crystal frequency multiplexer 30b in accordance with the principles of the present invention that employs cavity-mode selection coupling provided by a cavity 33 formed between the signal input 32 and the plurality of photonic bandgap filters 20. This embodiment of the frequency multiplexer 30b uses N photonic bandgap filters 20 to tailor the modes of a cavity 33 in order to effect 1-to-N frequency multiplexing. Each photonic bandgap filter 20 is designed to provide the appropriate bandpass characteristics so that, together, the N filters 20 cover the total incoming signal bandwidth. The basic construction of the frequency multiplexer 30b is substantially the same as is described above with reference to the first embodiment, except that it uses cavity-mode selection coupling instead of divider network coupling.

The principle of operation of the frequency multiplexer 30b of FIG. 7 is as follows. The input signal containing frequency components in bands F1 through F4 is launched into the cavity 33 through the signal input 32 and propagates towards the signal outputs 23. Propagation through the filters 20a–20d outside their respective frequency passbands is forbidden. Multiplexing occurs by virtue of the fact that the spatial location of the filters 20a–20d tailors the propagation properties of the cavity 33 in such a way that N propagating modes (in this example N=4), IN-OUT F1, IN-OUT F2, IN-OUT F3, IN-OUT F4, are established, thus linking the different input frequency bands and the signal output 23. These modes are eigenmodes of the cavity 33, and are orthogonal. Therefore there is no substantial coupling or interaction between the filters 20a–20d.

Thus, photonic bandgap crystal frequency multiplexers and photonic bandgap or pulse blanking filters have been disclosed. It is to be understood that the described embodiments are merely illustrative of some of the many specific embodiments which represent applications of the principles of the present invention. Clearly, numerous and varied other arrangements may be readily devised by those skilled in the art without departing from the scope of the invention.

What is claimed is:

1. A pulse blanking filter comprising:

a wave launching antenna;

a waveguide-like cavity;

a receiving antenna;

a photonic bandgap crystal disposed in the waveguide-like cavity that comprises a dielectric substrate having upper and lower metal boundaries that define lengths of dielectric members therein, and at least one switch interconnecting pairs of dielectric members formed in the substrate.

2. The filter of claim 1 wherein the switch comprises a microelectromechanical switch.

3. The filter of claim 1 wherein the photonic bandgap crystal comprises a substrate having a periodic one-dimensional array of dielectric members.

4. The filter of claim 1 wherein the photonic bandgap crystal comprises a substrate having a periodic two-dimensional array of dielectric members.

5. The filter of claim 1 wherein the lengths of the dielectric members are determined by the upper and lower metal boundaries of the photonic bandgap crystal, and are smaller than the intended wavelengths of operation of the filter.

6. A frequency multiplexer comprising:

a signal input;

a plurality of signal outputs;

a 1-to-N power divider network coupled to the signal input; and a predetermined number of photonic bandgap filters coupled between the 1-to-N power divider network and the plurality of signal outputs that are driven by the divider network, and wherein each photonic bandgap filter has a predetermined bandpass characteristic such that, together, the filters cover a total input signal bandwidth wherein the photonic bandgap filters each comprise:

a wave launching antenna;

a waveguide-like cavity;

a receiving antenna;

a photonic bandgap crystal disposed in the waveguide-like cavity that comprises a dielectric substrate having upper and lower metal boundaries that define lengths of dielectric members therein, and at least one switch located in the substrate interconnecting pairs of dielectric members formed in the substrate.

7. The multiplexer of claim 6 wherein the switch comprises a microelectromechanical switch.

8. The multiplexer of claim 6 wherein the photonic bandgap crystal comprises a substrate having a periodic one-dimensional array of dielectric members.

9. The multiplexer of claim 6 wherein the photonic bandgap crystal comprises a substrate having a periodic two-dimensional array of dielectric members.

10. The multiplexer of claim 6 wherein the lengths of the dielectric members are determined by the upper and lower metal boundaries of the photonic bandgap crystal, and are smaller than the intended wavelengths of operation of the filter.

11. A frequency multiplexer comprising:

a signal input;

a plurality of signal outputs;

a cavity formed adjacent the signal input; and a predetermined number of photonic bandgap filters coupled between the cavity and the plurality of signal outputs and wherein each photonic bandgap filter has a predetermined bandpass characteristic such that, together, the filters cover a total input signal bandwidth, and wherein the spatial locations of the filters tailor the propagation properties of the cavity so that a corresponding plurality of propagating modes are established linking the different input frequency bands and the signal output.

wherein the photonic bandgap filters each comprise:

a wave launching antenna;

a waveguide-like cavity;

a receiving antenna;

a photonic bandgap crystal disposed in the waveguide-like cavity that comprises a dielectric substrate having upper and lower metal boundaries that define lengths of dielectric members therein, and at least one switch located in the substrate interconnecting pairs of dielectric members formed in the substrate.

12. The multiplexer of claim 11 wherein the propagating modes are orthogonal eigenmodes of the cavity, so that there is no substantial coupling or interaction between the filters.

13. The multiplexer of claim 11 wherein the switch comprises a microelectromechanical switch.

14. The multiplexer of claim 11 wherein the photonic bandgap crystal comprises a substrate having a periodic one-dimensional array of dielectric members.

15. The multiplexer of claim 11 wherein the photonic bandgap crystal comprises a substrate having a periodic two-dimensional array of dielectric members.

16. The multiplexer of claim 11 wherein the lengths of the dielectric members are determined by the upper and lower metal boundaries of the photonic bandgap crystal, and are smaller than the intended wavelengths of operation of the filter.

* * * * *